United States Patent [19]

Minami

[11] Patent Number: 4,515,487

[45] Date of Patent: May 7, 1985

[54] MULTICOLOR PRINTER

[75] Inventor: Hitoshi Minami, Soka, Japan

[73] Assignee: Pentel Kabushiki Kaisha, Tokyo, Japan

[21] Appl. No.: 479,647

[22] Filed: Mar. 28, 1983

[30] Foreign Application Priority Data

Mar. 29, 1982 [JP] Japan ..... 57-50676
Mar. 29, 1982 [JP] Japan ..... 57-50677

[51] Int. Cl.[3] ..... B41J 3/12; B41J 35/16

[52] U.S. Cl. ..... 400/121; 400/126; 400/240.4

[58] Field of Search ..... 400/121, 124, 126, 240.4, 400/470

[56] References Cited

U.S. PATENT DOCUMENTS 4,378,566 3/1983 Tsukamura ..... 400/240.4 X
4,403,874 9/1983 Payne et al. ..... 400/124

FOREIGN PATENT DOCUMENTS 185168 11/1982 Japan ..... 400/121

*Primary Examiner*—Paul T. Sewell
*Attorney, Agent, or Firm*—Robert E. Burns; Emmanuel J. Lobato; Bruce L. Adams

[57] ABSTRACT

A multicolor printer for moving together and driving at predetermined timing a plurality of dot system printing heads provided for each color of three primary colors, yellow, magenta and cyan to effect multicolor printing. The multicolor printer stores by color, dot patterns for one line portion to be printed in correspondence to each of printing heads to individually drive a predetermined printing head in accordance with output data of line buffers. This multicolor printer further comprises a printing head for printing a black color and drives said printing head to print a character or the like in black in the absence of black color designation or color information data.

4 Claims, 9 Drawing Figures

FIG. 2
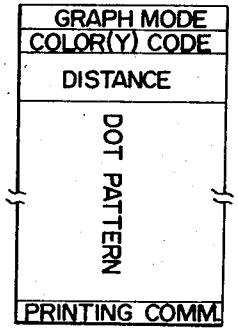
FIG. 3
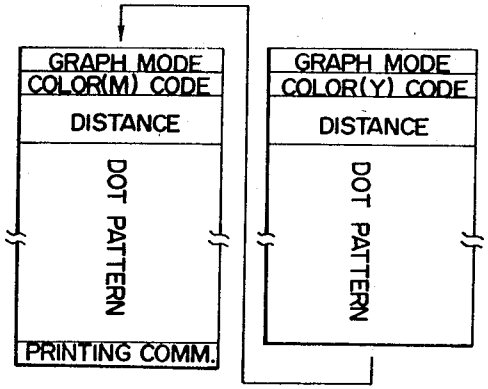
FIG. 4
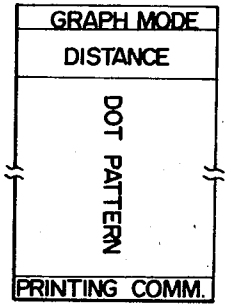
FIG. 5
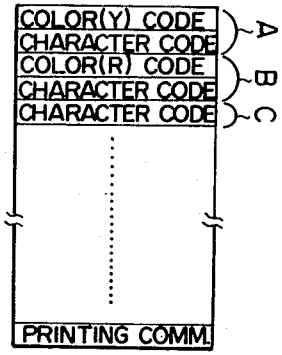
FIG. 6a FIG. 6b
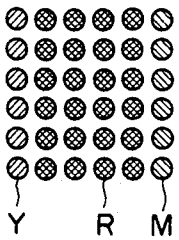
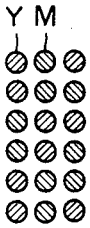
FIG. 7a FIG. 7b
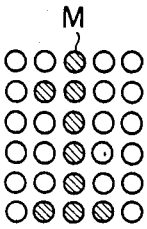
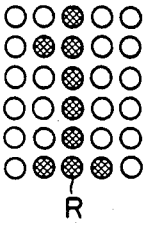

MULTICOLOR PRINTER

BACKGROUND AND FIELD OF THE INVENTION

The present invention relates to multicolor printers, and more particularly, to a multicolor printer which can print characters, figures, patterns, etc. by collection of dots in which a plurality of colors are combined.

In an information processing system using a computer, output data such as characters, figures and the like put out from a processor are, in most cases, displayed on a display device such as a CRT display. Also, recently, this display is achieved in a color form, which is widely used particularly for a solid display of spherical bodies, a display of temperature distribution and tomography of plane bodies, and the like because a color display therefor is suitable. On the other hand, with such a color display, there has been a growing need in which color data is not only merely displayed on the display but also when it is desired as a visual data, a hard copy is obtained to record and keep it so that the data may be seen repeatedly.

To achieve the aforesaid need, in the past, Japanese Patent Application Laid-Open No. 53-82526, for example, has proposed an arrangement wherein a plurality of ink ribbons by color are provided, and said ink ribbons are selectively moved towards wire heads or type heads to select a color. As a further proposal, Japanese Patent Application Laid-Open No. 56-33972, for example, has proposed an arrangement wherein a peripheral surface of a platen is axially divided into a plurality of sections, a plurality of color inks are permeated into said divided sections, and the platen is rotated towards type elements to select a color.

Such prior art techniques have disadvantages in that since selection of colors to be printed is effected mechanically, the operation is slow, that particularly when color is desired to be changed for each dot as in graphic data, it takes a considerable time, and that a printing mechanism is severely worn to shorten the service life of the printer.

SUMMARY OF THE INVENTION

It is an object of the present invention to provide a multicolor printer which is simple in structure and which can transfer printing data at a high speed and effect printing in multicolor at a high speed.

It is a further object of the present invention to provide a multicolor printer in which a plurality of dot system print heads by color are provided to reduce time necessary for selection of color, dot pattern data by color for one line portion are received and stored, and color-mixed printing is carried out in accordance with the movement of the heads.

In accordance with the present invention, there is provided a multicolor printer for moving together and driving at predetermined timing a plurality of dot system printing heads provided for each color of three primary colors, yellow, magenta and cyan to effect multicolor printing, which printer comprises a plurality of line buffers for storing dot patterns for one line portion to be printed by color in correspondence to each of the printing heads; a plurality of head driving circuits for individually driving the printing heads in accordance with output data of said line buffers; and data selector means for selectively putting out dot pattern data with color information of three primary colors to a predetermined line buffer designated by the color information.

In accordance with a preferred embodiment of the present invention, the multicolor printer further comprises, in addition to the printing heads of three primary colors, a black printing head, a line buffer for black color for storing black dot pattern data, and a character generator for generating character dot patterns in accordance with character data out of printing data. The data selector means is provided put out dot pattern data without color information to the line buffer for black color and selectively put out character pattern data which are outputs of the character generator to a predetermined line buffer designated by said data. In the multicolor printer of the present invention, since well known printing heads may be used without modification as the printing heads of the present invention, wire dot printing heads which use ink ribbons or ink jet printing heads of a charged-control system, Hertz system or ON-Demand system which jet ink to effect printing can also be used.

BRIEF DESCRIPTION OF THE DRAWINGS

FIGS. 2–4 are explanatory views showing a transfer format of printing data from a computer in a graphic mode;

FIG. 5 is an explanatory view showing a transfer format of data from a computer in a text mode;

FIGS. 6*a* and 6*b* are explanatory views showing a mixture of printing dots.

FIGS. 7*a* and 7*b* are explanatory views showing printing dots in a text mode.

DESCRIPTION OF PREFERRED EMBODIMENTS

Figure 1:
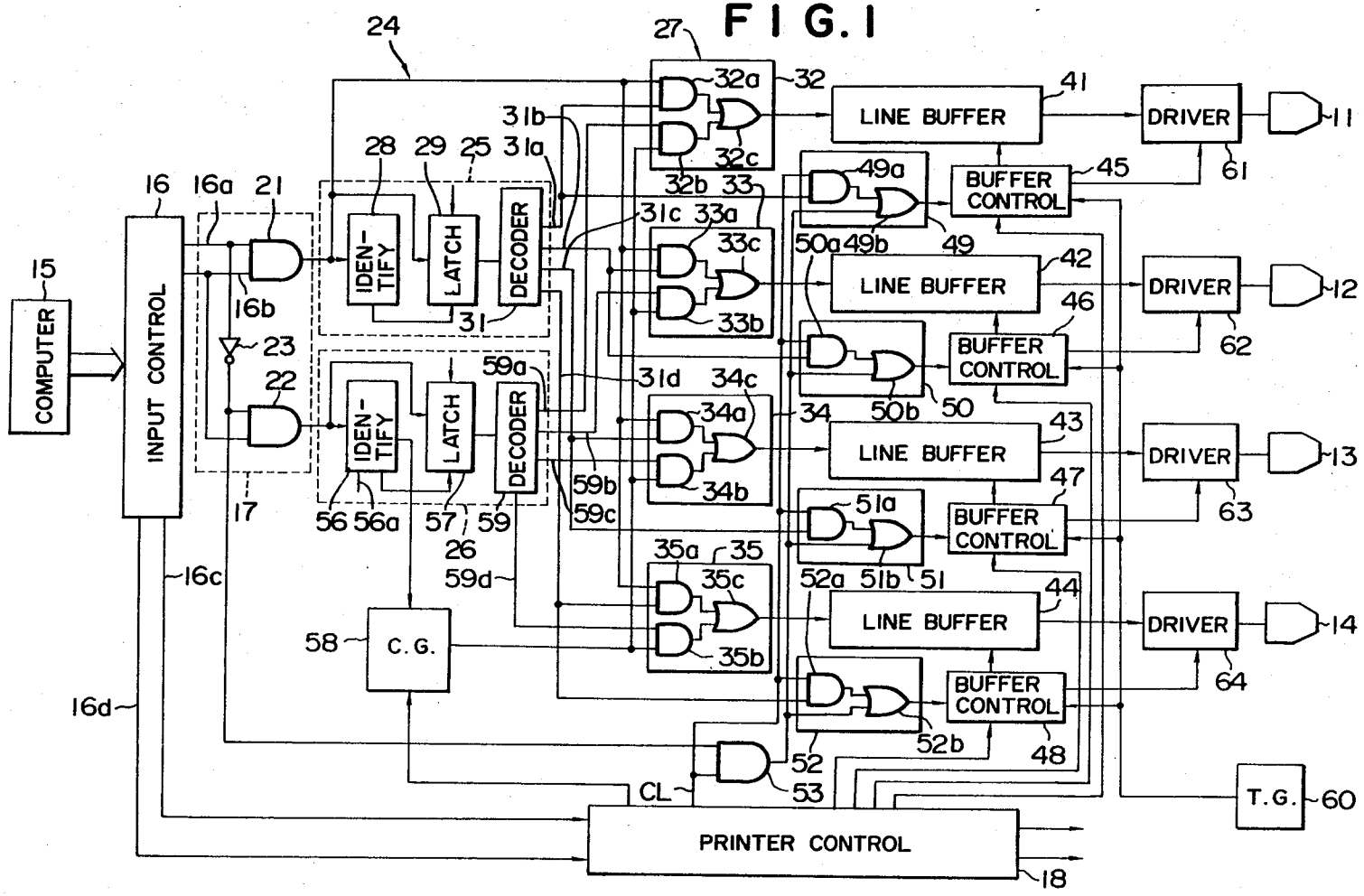
FIG. 1 is a block diagram showing one embodiment of a multicolor printer in accordance with the present invention.

One embodiment of a multicolor printer in accordance with the present invention will now be described in connection with the accompanying drawings. This multicolor printer comprises printing heads 11, 12, 13 and 14 by four different colors, i.e., yellow (Y), magenta (M), cyan (C) and black positioned at one and the same line with respect to a recording medium (not shown), said printing heads 11–14 being controlled by printing data entered from the outside, such as, from a computer 15. These printing heads 11–14 can be of either ink system wire dots or ink jet system, which have been well known, and detailed description of the construction thereof and drawings are omitted.

A transfer format fed from the computer 15 in accordance with a data format as shown in FIGS. 2–5 first enters an input control section 16. The input control section 16 puts out, depending on that received data are a graphic mode or a text mode, printing data such as dot pattern data and character data including a mode signal representative of mode thereof and color information representative of color code data, or printing data not including color information. A mode signal "0" representative of text mode or a mode signal "1" representative of graphic mode is applied to an output conductor 16*a* of the input control section 16, and printing data are applied to an output conductor 16*b*. The input control section 16 also puts out necessary signals in accordance with various control information within the received data, to a printer control section 18, which will be described hereinafter.

An input side of a mode switching circuit 17 is connected to the output conductors 16*a* and 16*b* of the input control section 16. The mode switching circuit 17 is composed of two AND gates 21, 22 and an inverter 23, and one input terminal of the AND gate 21 is connected to the output conductor 16*a* and the other input terminal thereof connected to the output conductor 16*b*. On the other hand, one input terminal of the AND gate 22 is connected to the output conductor 16*a* through the inverter 23 and the other input terminal thereof connected to the output conductor 16*b*. When receiving the graphic data separated into three primary colors as shown in FIG. 2 from the computer, the input control section 16 first applies a mode signal "1" to the mode switching circuit 17 in accordance with the graphic mode information, and the succeeding three primary colors, yellow, magenta and cyan, or color code data such as black are put out from the AND gate. Further, a numerical signal by dot representative of distance data is put out to the printer control section 18 through the output conductor 16, after which the printing dot pattern is delivered from the AND gate 21. After the printing dot pattern for a portion of the distance data has been delivered, the input control section 16 automatically switches the mode signal to "0" as the text mode. Separately therefrom, when text data as shown in FIG. 5 is received from the outside, printing data comprising color codes (in the text mode, red (R), green (G), blue (B), yellow magenta, cyan and black) and character code data is put out from an output terminal of the AND gate since the input control section 16 has pre-delivered the mode signal "0" to the mode switching circuit 17.

Selector means 24 is connected to the output side of the mode switching circuit 17. This data selector means 24 comprises a graphic color designation section 25, a text color designation section 26 and a gate section 27. The graphic color designation section 25 comprises a descrimination circuit 28 having an input connected to an output terminal of AND gate 21, a latch circuit 29 having one input connected to the output terminal of the AND gate 21 whereas the other input thereof connected to an output of the discrimination circuit 28, and a decoder 31 having an input connected to an output of the latch circuit 29. The discrimination circuit 28 has a function to detect color code data out of the printing data received from the AND gate 21, and immediately after color code data has been detected, delivers a latch strobe signal to the latch circuit 29. The latch circuit 29 feeds the latched color code to the decoder 31 connected to the output thereof. The decoder 31 has output conductors 31*a*, 31*b*, 31*c* and 31*d*. When the color code data is not received from the latch circuit 29, only the output conductor 31*d* is maintained at "1", and other output conductors 31*a*, 31*b* and 31*c* are maintained at "0". It has a further function that when color code data related to four colors, i.e., yellow, magenta, cyan and black, is received from the latch circuit 29, only one output conductor Di (i=0−3) corresponding to said color code is maintained at "1" and other conductors are maintained at "0". Output "1" of each of the output conductors 31*a*–31*d* represents a color designation of each color, yellow, magenta, cyan, and black. The latched state of the latch circuit 29 is released by control of the printer control section 18 simultaneously with the termination of input of a printing dot pattern relating to a certain color designation into a predetermined buffer.

Output conductors 31*a*–31*d* of the decoder 31 are respectively connected to gate circuits 32, 33, 34 and 35 within the gate section 27. As for the example of the gate circuit 32, the gate circuit 32 is composed of two 2-input AND gates 32*a* and 32*b*, and an OR gate 32*c* to an input of which is connected an output of said AND gates. The AND gate 32*a* has one input terminal connected to an output terminal of the AND gate 21, and has the other input terminal connected to the output conductor 31*a* of the decoder 31. The remaining gate circuits 33, 34 and 35 also have a construction and a connection similar to those of the AND circuit 32. Thus, the printing dot pattern put out from the AND gate 21 is put out from the AND gate of one of the AND gates 32*a*, 33*a*, 34*a* and 35*a* designated in color by the decoder 31 through one of the corresponding OR gates 32*c*, 33*c*, 34*c* and 35*c*.

Four line buffers 41, 42, 43 and 44 provided by color are connected to outputs of the gate circuits 32–35. Each of the line buffers 41–44 have a capacity which can store and hold dot patterns for one line portion and are respectively provided with line buffer control circuits 45, 46, 47 and 48 and write-clock gate circuits 49, 50, 51 and 52. These write-clock gate circuits 49–52 are respectively composed of a 2-input AND gate 49*a*, 50*a*, 51*a* and 52*a* and a 2-input OR gate 49*b*, 50*b*, 51*b* and 52*b*. Connection will now be described by way of the gate circuit 49. One input terminal of the AND gate 49*a* is connected to the output conductor 31*a* of the decoder 31, and the other input terminal thereof is connected to a clock signal conductor CL which is an output of the printer control section 18. An output terminal of the AND gate 49*a* is connected to one input terminal of the OR gate 49*b*, and the other input terminal of the gate 49*b* is connected to an output terminal of the 2-input AND gate 53. An output terminal of the OR gate 49*b* is connected to an input of the line buffer control circuit 45. One input terminal of the AND gate 53 is connected to an output of the inverter 23 and the other input terminal thereof is connected to the clock signal conductor CL. The remaining three gate circuits 50, 51 and 52 are also similarly connected to the output conductors 31*b*, 31*c* and 31*d* and the line buffer control circuits 46, 47 and 48.

When the dot column numeral signal is received through the output conductor 16*c* from the input control section 16 at the graphic mode, the printer control section 18 provides the write signal to each of the line buffer control circuits 45–48. Also, the clock pulses for the dot column numeral portion are put out while being synchronized with delivery timing of dot pattern data put out from the input control section 16 through the AND gate 21 and the gas section 27. This clock signal is fed to the corresponding line buffer control circuit 45–48 via any one of the clock gate circuits 49–52 designated by the decoder 31. The line buffer control circuits 45–48 sequentially provide increment of addresses of the buffer designated in color out of the line buffers 41–44 to sequentially store column by column the dot pattern data delivered from any one of the gate circuits 32–35. At this time, none is written in the line buffers relating to other colors not selected by the decoder 31.

Upon termination of receiving of and storing, into the predetermined line buffer, of printing dot patterns for the dot column numeral portion expressed by distance data in connection with a certain color in the graphic mode, the printer control section 18 stops outputting the clock pulse and delivers a latch release signal to the latch circuit 29 to provide output "1" only for the conductor 31*c* of the decoder 31, whereas the input control section 16 sets the mode signal to "0". In case of continuously receiving the dot pattern date of the graphic mode relating to a plurality of colors as shown in FIG. 3, the respective dot patterns are stored in the required line buffers 41–44 designated in color, in the exactly same procedure as that previously mentioned. Also, as shown in FIG. 4, the dot pattern data without color code in the graphic mode is stored in the black line buffer 44. Accordingly, even in case the dot pattern data for normal graphic mode without color code data is received, printing is possible to be made and an extremely great generality of the printer for data transmitted results.

Next, the color designation section 26 for text of the data selector means 24 in connection with the text mode will be described. The color designation section 26 for text comprises a discrimination circuit 56 having an input connected to the output terminal of the AND gate 22, a latch circuit 57 having one inplut connected to the output terminal of the AND gate 22 and the other input connected to one output of the discrimination circuit 56, and a decoder 59 having an input connected to the output of the latch circuit 57. The discrimination circuit 56 has an output connected to one input of a character generator 58. In case of receiving color code date out of printing data fed from the AND gate 22, the discrimination circuit 56 provides a latch strobe signal to the latch circuit 57, and in case of receiving character code data, the discrimination circuit 56 puts out the character code data to the character generator 58 and delivers a character code detection signal to the printer control section 18 from the output conductor 56*a*. On the other hand, the latch circuit 57 feeds the latched color code data to the decoder 59 connected to the output. This decoder 59 has functions such that when color coded data is not received from the latch circuit 57, the decoder holds only the output conductor 59*d* at "1" and the other output conductors 59*a*, 59*b* and 59*c* at "0", and when color code date consisting of seven colors, i.e., red, green, blue, yellow, magenta, cyan and black whose primary colors are yellow, magenta and cyan, from the latch circuit 57, the decoder sets only one output line Di (i=0−3) or two output lines Dj, Dh (j, h=0−2, j=k) corresponding to these color code data to "1" and the others to "0" level. The output "1" of the output conductors 59*a*–59*d* represents the color designation of yellow, magenta, cyan and black, and if suitable two output conductors out of the output conductors 59*a*–59*c* are set to "1", color designation of red, green and blue can be made. The color designation of black is effected not by setting all of the output conductors 59*a*–59*c* to "1" but setting only the output conductor 59*d* to "1". The latched state of the latch circuit 57 is released by the control of the printer control section 18 simultaneously with the termination of input of the dot pattern corresponding to the character code relating to color designation into the line buffer.

The output conductors 59*a*, 59*b*, 59*c* and 59*d* of the decoder 59 are respectively connected to one input terminals of the 2-input AND gates 32*b*, 33*b*, 34*b* and 35*b* provided on the gate circuits 32–35 within the gate section 37, and the other input terminals of the AND gates 32*b*–35*b* are connected to the output of the character generator 58. This character generator 58 has a function such that when character code data is received from the discrimination circuit 56, the character generator generates a character dot pattern. On the other hand, the printer control circuit 18 in which a character detection signal is received from the discrimination circuit 56 delivers a read-out timing signal to the character generator 58 to put out character dot patterns column by column. The character dot pattern is put out to the line buffers 41–48 through the OR gates 32*c*–35*c* respectively corresponding to one AND gate 32*b*–35*b* in case of yellow, magenta, cyan or black designated in color by the decoder 59 and to two AND gates 32*b*–35*b* in case of red, green or blue. When receiving the character code detection signal from the discrimination circuit 56, the printer control section 18 applies a write signal to each of the line buffer control circuits 45–48 to put out a clock signal while being synchronized with a read-out timing signal put out to the character generator 58. This clock signal is fed to the line buffer control circuits 45–48 through the AND gate 53 which has received level "1" at the text mode and the write-clock gate circuits 49–52. The line buffer control circuits 45–48 each sequentially provide increment addresses of the line buffers by the number as required in accordance with the clock signal, and a character dot pattern for one character portion is stored in one or two buffer designated in color by the decoder 59. Space data for one character portion is stored in the line buffer relating to other colors not designated in color. After the dot pattern data for one character portion designated in color in the text mode has been stored into the line buffer, the printer control section 18 stops outputting the clock pulse to add a latch release signal to the latch circuit to put out "1" only for the output conductor 59*c* of the decoder 59. However, a mode signal output of the input control section 16 is kept at "0". When receiving character code data with color code data of the text mode relating to a plurality of continuous characters as indicated by A and B in FIG. 5, said character pattern and a space are sequentially stored in parallel mode into the line buffer designated in color and into other line buffers, respectively, in the exactly same operation as that previously described. Further, when receiving character codes without color code in the text mode as shown by C in FIG. 5, dot pattern data releating to the character code is stored in the line buffer 44 for black predesignated by the decoder 59, and space data are stored in other line buffers 41–43. Accordingly, even in case of receiving normal text character code data without color code data, printing is possible to be made.

After required dot pattern data have been stored into the line buffers 41–44 in the graphic mode or text mode, the printer then starts printing operation. Various printing mechanisms have been proposed as previously mentioned and the conventional printing mechanism of the multicolor printer can be used and therefore, the detailed description and drawings thereof are omitted. The printing operation commences with a printing command input from the input control section 16. When the printing command is received by the input control section 16, a printing start signal is fed from the output conductor 16*d* of the input section 16 to the printer control section 18. By this printing start signal, the printer control section 18 feeds a drive signal to a carriage moving pulse motor (not shown) of the printing mechanism.

On the carriage is mounted four printing heads 11–14 in order of yellow, magenta, cyan and black from righthand in a predetermined spaced relation laterally, that is, in a line direction, the printing heads being moved together in the line direction as the carriage moves. These printing heads 11–14 simultaneously print dots for one column portion which comprises a plurality of dots aligned in a longitudinal direction corresponding to a longitudinal width of one line, and such a printing is repeatedly carried out in the line to thereby print dot-matrix like characters, figures, patterns, etc. When the carriage is moved, printing timing signals are put out from a printing timing signal generator 60 to each of the line buffer control circuits 45–48. Readout signals from the printer control section 18 are sequentially input into the line buffer control circuits 45–48 at a predetermined delay time determined by the travelling speed of the carriage and the spacing between the printing heads 11–14. When the printing start signal is input from the input control section 16, the printer control section 18 immediately puts out said read-out signal. Starting with the input of the read-out signal from the printer control section 18, the line buffer control circuits 45–48 read-out, column by column, pattern data within the corresponding line buffers 41–44 while sequentially providing increment of addresses in accordance with the printing timing signal, to put them out to the drive circuits 61–64 connected to the outputs of the line buffers 41–44. The line buffer control circuits 45–48 also feed driving timing signals to the drive circuits 61–64. The pattern data stored in the line buffers 41–44 are sequentially printed column by column by the printing heads 11–14. However, when the dot pattern data is not stored in the line buffers 41–44, the line buffer control circuits 45–48 do not perform the reading of data from the line buffers 41–44 and the feeding of the driving timing signal to the drive circuits 61–64 so as to avoid the accomplishment of printing operation by the printing heads 11–14. The printer control section 18 further has, in addition to the function of controlling the printing mechanism as described above, a function of accomplishing the driving and control in accordance with information such as "begin a new line", "begin a new page", paper feed, etc. received by the input control section.

Assume now that dot pattern data of a single color of yellow is received for example in the graphic mode and then a printing command is input, said dot pattern is stored only in the line buffer 41, after which only the printing head 11 is driven to print only the data of yellow for one line portion. When dot pattern data of magenta is received next to the yellow dot pattern data, after which a printing command is input, dot pattern data of every color are stored in the line buffers 41 and 42 and then the printing heads 11 and 12 are driven. In a portion in which dots of yellow and magenta are printed on one and the same place or in a portion as shown in FIG. 6*a*, or in a portion in which they are juxaposed adjacent to each other, reduction mixed-color and juxtaposition mixed-color occur to form one or a group of red dots. Of course, the printing heads 11–14 each print dots on one and the same position on a recording sheet. On the other hand, in the case where dot pattern data without color code is received externally, printing is accomplished in the exactly same manner as that of the dot pattern with a black color code.

Where in the text mode, character code data with seven color codes are received, either character dot pattern or space data is stored in all the line buffers 41–44, and therefore, all the printing heads 11–14 are driven during the printing. However, if only the space data is stored in the line buffer, the printing operation of said printing heads is not achieved. In this text mode, a dot pattern of one character as a whole is printed for every character in the form of primary-color printing or reduction mixed-color printing to colors designated in color code. On the other hand, if character code data without color code is received externally, printing is achieved in the exactly same manner as that of the dot pattern data with black color code.

Alternatively, printing data can be transmitted in a graphic mode to a position halfway of one line from outside and thereafter, printing data can be transmitted in a text mode, whereby printing in the mixture of a graphic pattern and a character pattern in one and the same line may be achieved.

While in the above-described embodiment, the graphic color designation section and the text color designation section are separately provided, it should be understood that a single color designation section can be provided for common use, and color information of mixed-colors in the text mode can be obtained from a combination of two 3-primary color code data.

What is claimed is:

1. A multicolor printer for moving together and driving at predetermined timing a plurality of dot system printing heads provided for each color of three primary colors, yellow, magenta and cyan, to effect multicolor printing, comprising:

a plurality of line buffers for storing dot patterns for one line portion to be printed by color in correspondence to each of the printing heads;

a plurality of head driving circuits for individually driving the printing heads in accordance with output data of said line buffers; and data selector means for selectively putting out dot pattern data with color information of three primary colors to a predetermined line buffer designated by said color information, said data selector means comprising a discrimination circuit for detecting said color information from said dot pattern data and printing data, and a decoder circuit for actuating said line buffer as required by said color information from said discrimination circuit to render said remaining line buffers inoperable.

2. A multicolor printer according to claim 1, further comprising a printing head for black and a line buffer for black for storing black dot pattern data, said data selector means being adapted to put out dot pattern data without said color information to said line buffer for black.

3. A multicolor printer for moving together and driving at predetermined timing a plurality of dot system printing heads provided for each color of three primary colors, yellow, magenta and cyan, to effect multicolor printing, comprising:

a plurality of line buffers for storing dot patterns for one line portion to be printed by color in correspondence to each of the printing heads;

a plurality of head driving circuits for individually driving the printing heads in accordance with output data of said line buffers;

a character generator for generating character dot patterns in accordance with character data in printing data; and data selector means for selectively putting out character data patterns which are outputs of said character generator to said required line buffer designated by color information of said printing data and putting out space data to said other line buffers, said data selector means comprising a discrimination circuit for detecting said color information from said dot pattern and printing data and actuating said character generator, a decoder circuit for actuating said line buffer as required by said color information from said discrimination circuit to put out space data to said remaining line buffers, and a buffer control circuit.

4. A multicolor printer according to claim 3, further comprising a printing head for black and a line buffer for black for storing black dot pattern data, said data selector means being adapted to put out dot pattern data without said color information to said line buffer for black.

* * * * *